US010130225B2

(12) United States Patent
Yun

(10) Patent No.: US 10,130,225 B2
(45) **Date of Patent: *Nov. 20, 2018**

(54) VACUUM CLEANER

(71) Applicant: SAMSUNG ELECTRONICS CO., LTD., Suwon-si, Gyeonggi-do (KR)

(72) Inventor: Min Ro Yun, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 216 days.

This patent is subject to a terminal disclaimer.

(21) Appl. No.: 14/837,629

(22) Filed: Aug. 27, 2015

(65) Prior Publication Data

US 2015/0359396 A1 Dec. 17, 2015

Related U.S. Application Data

(63) Continuation of application No. 13/537,928, filed on Jun. 29, 2012, now Pat. No. 9,144,356.

(30) Foreign Application Priority Data

Jul. 5, 2011 (KR) ..... 10-2011-0066535

(51) Int. Cl.

| | |
|---|---|
| ***A47L 9/04*** | (2006.01) |
| ***A47L 9/20*** | (2006.01) |
| *A47L 9/16* | (2006.01) |

(52) U.S. Cl.

CPC ..... *A47L 9/0477* (2013.01); *A47L 9/0483* (2013.01); *A47L 9/1683* (2013.01); *A47L 9/20* (2013.01); *A47L 9/1666* (2013.01)

(58) Field of Classification Search

CPC ..... A47L 9/0477; A47L 9/0483; A47L 9/20; A47L 9/1691; A47L 5/28; A47L 9/1666; A47L 9/1683

See application file for complete search history.

(56) References Cited

U.S. PATENT DOCUMENTS 2,960,714 A 11/1960 Senne
9,144,356 B2 * 9/2015 Yun ..... A47L 9/0477

(Continued)

FOREIGN PATENT DOCUMENTS

| | | |
|---|---|---|
| GB | 2469729 | 10/2010 |
| JP | 3-292920 | 12/1991 |

(Continued)

OTHER PUBLICATIONS

Decision on Grant dated Jan. 19, 2017 in corresponding European Patent Application No. 12 174 930.3, 38 pages.

(Continued)

*Primary Examiner* — Robert Scruggs
(74) *Attorney, Agent, or Firm* — Staas & Halsey LLP

(57) ABSTRACT

A cleaner including a case, a brush provided in the case so that the brush rotates to sweep foreign matter, a dust removal unit including a bar-type body and a dusting part directly extending from the bar-type body. The dust removal unit is moveable between a first position where the dusting part contacts the brush and a second position where the dusting part is separated from the brush. The cleaner also includes a first part directly connected to the bar-type body and a second part integrally formed with the first part and extending from an end of the first part. While a force is applied to the second part, the force is transmitted through the first part to the dust removal unit such that the dusting part moves from the second position to the first position.

9 Claims, 14 Drawing Sheets

(56) References Cited

U.S. PATENT DOCUMENTS

| | | | | |
|---|---|---|---|---|
| 2003/0204923 | A1 | 11/2003 | Nakamura | |
| 2009/0229075 | A1* | 9/2009 | Eriksson ..... | A46B 13/006 15/383 |

FOREIGN PATENT DOCUMENTS

| | | | |
|---|---|---|---|
| JP | 5-103740 | | 4/1993 |
| JP | 5-305044 | | 11/1993 |
| JP | 2006-312066 | A | 11/2006 |
| JP | 2006-334084 | A | 12/2006 |
| JP | 2008-382 | | 1/2008 |
| KR | 10-2010-0116860 | | 11/2010 |

OTHER PUBLICATIONS

Extended European Search Report dated Oct. 22, 2012 in corresponding European Patent Application No. 12174930.3.

U.S. Office Action dated Nov. 18, 2014 in copending U.S. Appl. No. 13/537,928.

U.S. Notice of Allowance dated Jun. 2, 2015 in copending U.S. Appl. No. 13/537,928.

U.S. Appl. No. 13/537,928, filed Jun. 29, 2012, Min Ro Yun, Samsung Electronics Co., Ltd.

Extended European Search Report dated Sep. 19, 2017 in corresponding European Patent Application No. 17172811.6.

Extended European Search Report dated Sep. 19, 2017 in corresponding European Patent Application No. 17172688.8.

Korean Office Action dated Jun. 21, 2017 in corresponding Korean Patent Application No. 10-2011-0066535 (7 pages) (6 pages English Translation).

Korean Office Action dated Jan. 17, 2018 in Korean Patent Application No. 10-2011-0066535.

Korean Office Action dated Mar. 12, 2018 in Korean Patent Application No. 10-2011-0066535.

* cited by examiner

VACUUM CLEANER

CROSS-REFERENCE TO RELATED APPLICATIONS

This application is a continuation of U.S. application Ser. No. 13/537,928 filed on Jun. 29, 2012, which claims the benefit of Korean Patent Application No. 10-2011-0066535, filed on Jul. 5, 2011 in the Korean Intellectual Property Office, the disclosure of which is incorporated herein by reference.

BACKGROUND

1. Field

Embodiments relate to an upright cleaner configured to remove dust from a drum brush.

2. Description of the Related Art

A cleaner is an apparatus that removes foreign matter from a room to clean the room. A vacuum cleaner is generally used at home. The vacuum cleaner suctions air using suction force of a blowing device and separates foreign matter from the suctioned air using a filter to clean a room. The vacuum cleaner may be classified as a canister type vacuum cleaner or an upright vacuum cleaner.

The canister type vacuum cleaner includes a main body having a blowing device and a dust collection device mounted therein, a suction body mounted separately from the main body to suction dust from a floor, and a connection hose connected between the main body and the suction body. To clean a room, therefore, a user may move the suction body in a cleaning direction while holding a handle mounted at the connection hose.

On the other hand, the upright cleaner includes an upright main body and a suction body integrally coupled to the lower part of the main body. To clean a room, therefore, a user may move the entirety of the upright cleaner in a cleaning direction while holding a handle mounted at the upper side of the main body.

In particular, a drum brush is mounted in the suction body of the upright cleaner to improve cleaning efficiency. The drum brush contacts a surface to be cleaned while being rotated at high speed to separate foreign matter from the surface. The separated foreign matter is suctioned into the suction body and is then introduced into a dust collection device provided in the main body.

In this case, some of the foreign matter suctioned into the suction body is rotated by rotational force of the drum brush rotated at high speed while being attached to the drum brush. As a result, cleaning efficiency is lowered.

SUMMARY

It is an aspect to provide an upright cleaner configured to remove dust from a drum brush.

Additional aspects of the invention will be set forth in part in the description which follows and, in part, will be obvious from the description, or may be learned by practice of the invention.

In accordance with an aspect, an upright cleaner may include a case having a suction port, a drum brush rotatably provided in the case to sweep and guide foreign matter to the suction port, a dust removal unit provided in the case so that the dust removal unit is moved between a first position where one side of the dust removal unit contacts the drum brush and a second position where the side of the dust removal unit is separated from the drum brush, and a lever connected to the dust removal unit to actuate the dust removal unit.

The dust removal unit may include a bar-type body and a dusting part extending from the body so that the dusting part contacts the drum brush at the first position and is separated from the drum brush at the second position.

The lever may include an extension part protruding above the case and a bent part extending from the end of the extension part so that the bent part is bent toward the front of the case, and the lever may be connected to the body.

The upright cleaner may further include an elastic part provided between the bent part and the top of the case to elastically bias the bent part upward.

Alternatively, one side of the lever may form an extension part protruding forward from the case, and the other side of the lever may be connected to the body.

The extension part may be provided at the lower end thereof with a support part protruding forward from the case, and the upright cleaner may further include an elastic part provided between the support part and the extension part to elastically bias the extension part upward.

The upright cleaner may further include an actuating unit coupled to the case to cover the extension part, the actuating unit being configured to be moved between an actuating position at which the extension part is pressed and a releasing position at which the extension part is released.

The actuating unit may include a front plate provided at the front of the extension part and an upper plate connected to the upper end of the front plate and bent rearward.

The upright cleaner may further include a locking unit hingedly coupled to the case above the upper plate, wherein the locking unit may lock the upper plate so that the actuating unit is held at the actuating position when the actuating unit is located at the actuating position.

The actuating unit may include an elastic support part extending downward from a hinge shaft coupled to the case so that the rear of the elastic support is supported at the case, a catching part extending frontward from the hinge shaft so that the end of the catching part protrudes more forward than the end of the support part, and a footstool part extending frontward from the hinge shaft.

The upper plate may be provided at one end thereof with an insertion groove formed by separation between the upper plate and the case, and the catching part may push the upper plate downward to hold the upper plate at the actuating position and may be received in the insertion groove at the releasing position.

The upright cleaner may further include a pressing part provided at the inside of the front plate at a position corresponding to the extension part to press the extension part when the actuating unit is moved to the actuating position.

The dusting part may include a brush.

The dusting part may include one or more brush bundles arranged at intervals.

In accordance with another aspect, an upright cleaner, having a suction body, a main body and a handle, the upright cleaner, may include a case forming the external appearance of the suction body, a drum brush rotatably provided in the case, and a dust removal unit movably provided in the case, the dust removal unit performing an actuating operation through which dust is removed from the drum brush and a releasing operation through which dust is removed from the drum brush.

The upright cleaner may further include a lever connected to the dust removal unit to control the dust removal unit to perform the actuating operation or the releasing operation.

In accordance with yet another aspect, an upright cleaner may include a main body having a motor and a dust collection device, a handle extending from the main body, the handle having a manipulation part to drive the motor, a suction body having a suction port to suction air and a discharge port to supply the suctioned air to the main body, a drum brush provided in the suction body so that the drum brush is rotated by the motor to sweep and guide foreign matter to the suction port, and a dust removal unit provided in the suction body so that the dust removal unit is moved between a first position where the dust removal unit contacts the drum brush and a second position where the dust removal unit is separated from the drum brush.

The dust removal unit may include a bar-type body and a dusting part extending from the body so that the dusting part contacts the drum brush at the first position and is separated from the drum brush at the second position.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
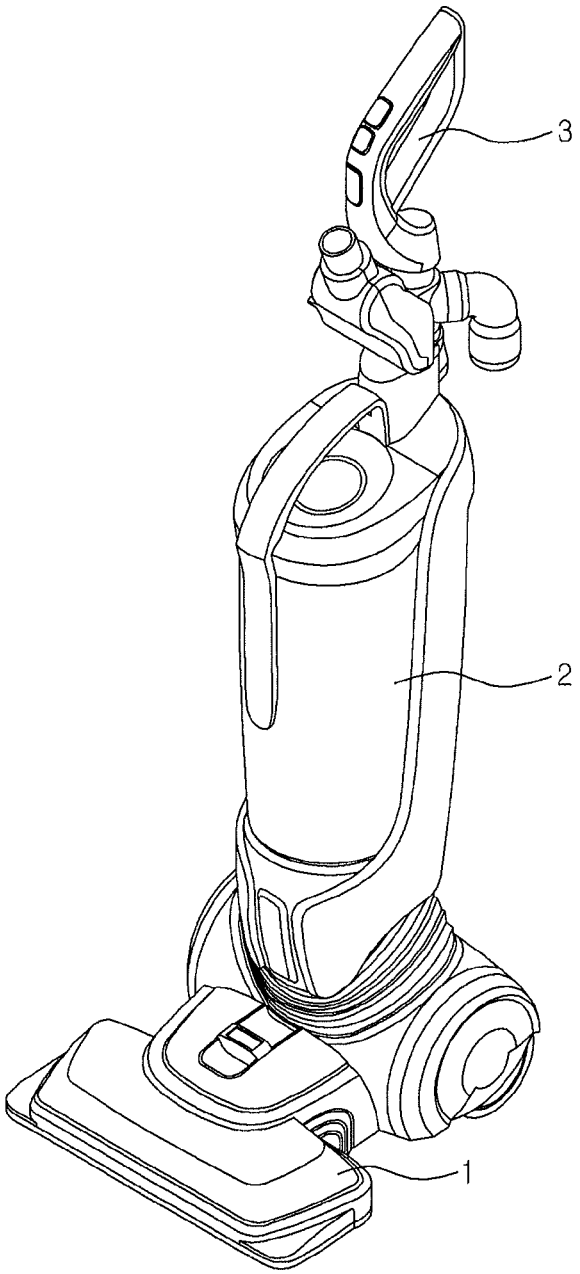
FIG. 1 is a perspective view schematically showing the external appearance of an upright cleaner according to an embodiment.

Reference will now be made in detail to the embodiments, examples of which are illustrated in the accompanying drawings, wherein like reference numerals refer to like elements throughout.

FIG. 1 is a perspective view schematically showing the external appearance of an upright cleaner according to an embodiment.

As shown in FIG. 1, the upright cleaner may include an upright main body 2, a suction body 1 mounted at the lower part of the front of the main body 2 to suction foreign matter from the floor in a room, and a handle 3 provided at the upper part of the main body 2 to allow a user to easily move the cleaner in a cleaning direction. Although not shown, a blowing device to generate suction force to suction foreign matter and a dust collection device to store the suctioned foreign matter may be mounted in the main body 2.

Figure 2:
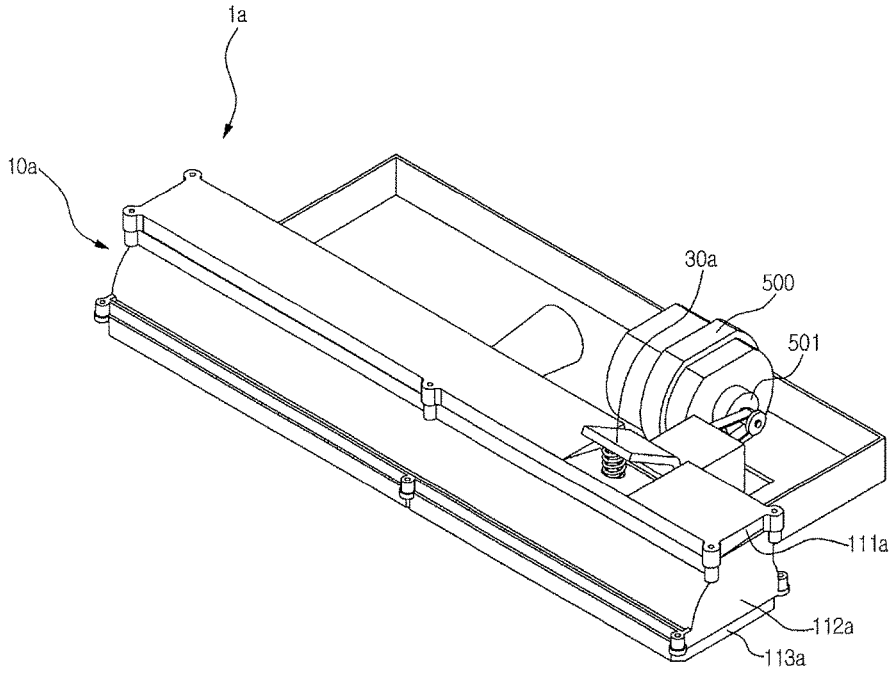
FIG. 2 is a perspective view schematically showing a suction body of the upright cleaner according to an embodiment.

FIG. 2 is a perspective view schematically showing a suction body of the upright cleaner according to an embodiment.

Figure 3:
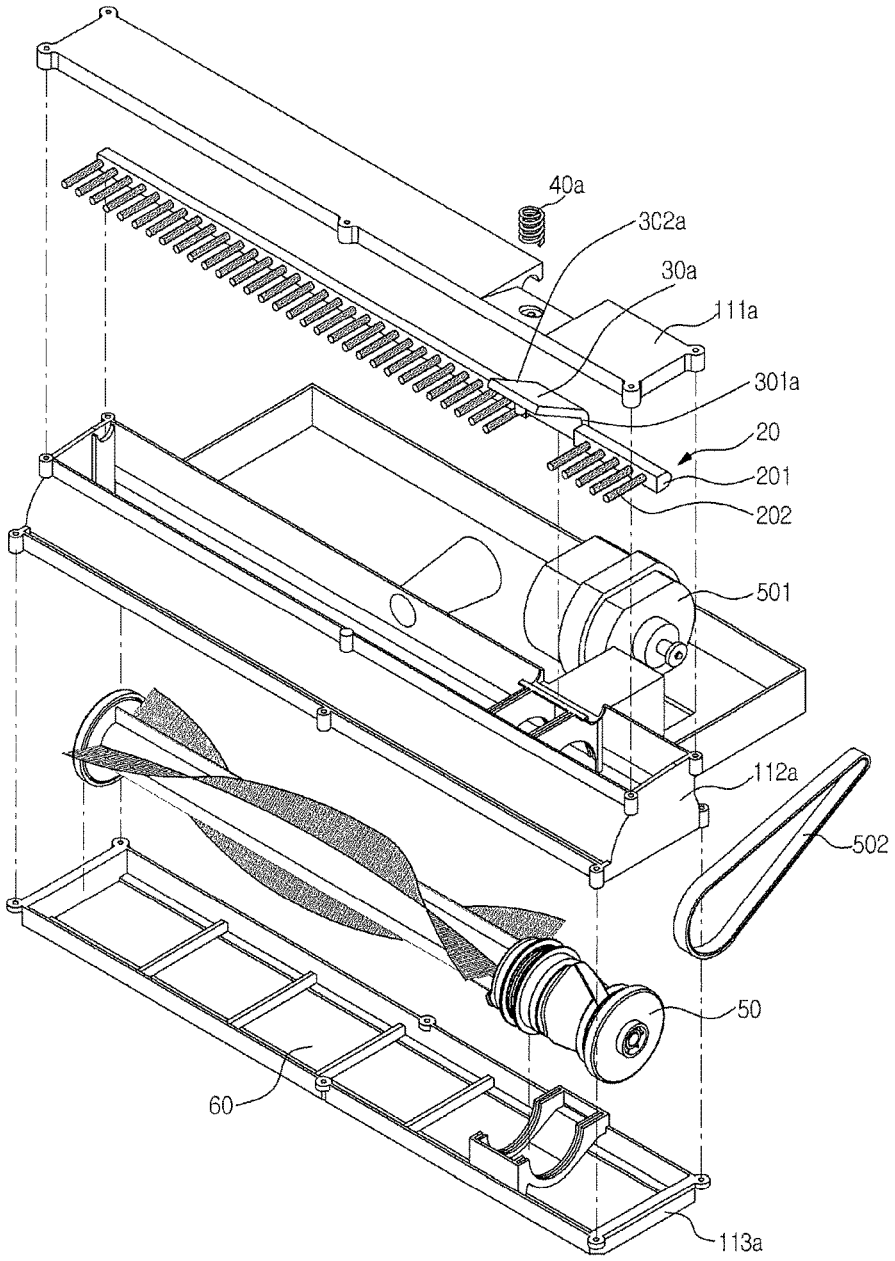
FIG. 3 is an exploded view showing components of the suction body of FIG. 2.

FIG. 3 is an exploded view showing components of the suction body of FIG. 2.

As shown in FIGS. 2 and 3, the suction body 1*a* may include a case 10*a* forming the external appearance thereof, a suction port 60 provided at the lower part of the front of the case 10*a* to suction foreign matter from the floor in a room, a drum brush 50 rotatably provided at the lower end of the front of the case 10*a* in the case 10*a* to sweep and guide foreign matter to the suction port 60, a motor 501 to rotate the drum brush 50, a belt 502 to transmit drive force from the motor 501 to the drum brush 50, a dust removal unit 20 provided in the case 10*a* to remove hair or dust from the drum brush 50, and a lever 30*a* to rotate the dust removal unit 20.

The drum brush 50 may be formed in the shape of a long cylinder. The drum brush 50 may be provided at the outer circumference thereof with a spiral brush extending outward.

During cleaning, the brush may sweep foreign matter from the floor to introduce the foreign matter into the suction port 60. At this time, hair or dust may be tangled on the brush.

The case 10*a* may include a case body 112*a*, an upper case 111*a* to cover the upper end of the case body 112*a*, and a lower case 113*a*, at which the suction port 60 is provided, to support the drum brush 50.

The dust removal unit 20 may include a bar-type body 201, by which the dust removal unit 20 is supported at the case 10*a*, and a dusting part 202 extending from the body 201 to contact the drum brush 50.

One side of the lever 30*a* may include an extension part 301*a* protruding above the upper case 111*a* and a bent part 302*a* extending from the end of the extension part 301*a* so that the bent part 302*a* is bent toward the front of the case 10*a*. The other side of the lever 30*a* may be connected to the body 201 of the dust removal unit 20.

The upright cleaner may further include an elastic part 40*a* provided between the upper case 111*a* and the bent part 302*a* of the lever 30*a* to elastically bias the bent part 302*a* upward.

The elastic part 40*a* may include a spring.

The elastic part 40*a* may include an elastic member to elastically bias the bent part 302*a* upward in addition to the spring.

At the lower end of the lever 30*a* may be provided a downward protrusion 303*a* to hold the upper end of the elastic part 40*a*.

The lower end of the elastic part 40*a* may be supported at the upper case 111*a*.

Figure 4A:
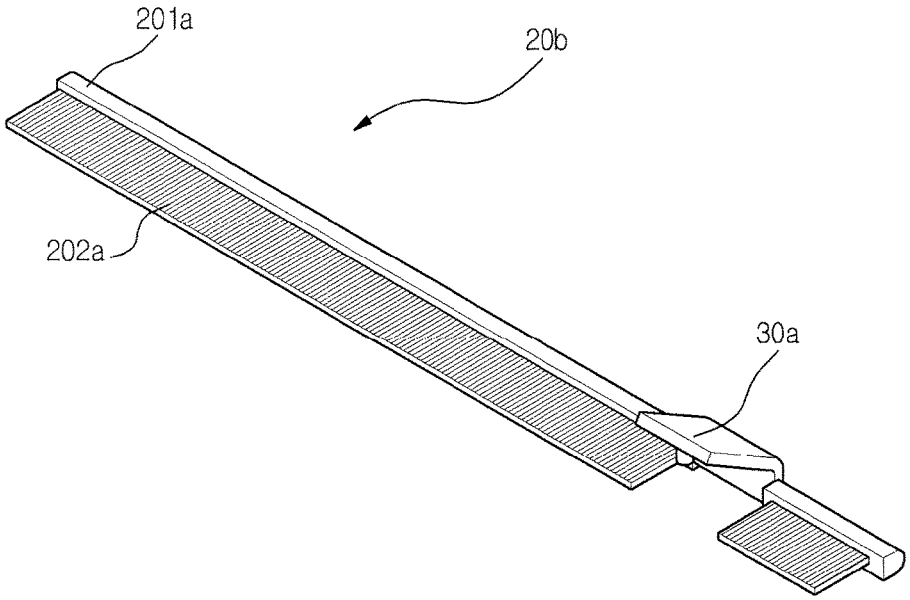
FIG. 4A is a view showing an example of a dust removal unit of the upright cleaner according to an embodiment.

FIG. 4A is a view showing an example of the dust removal unit of the upright cleaner according to an embodiment.

Figure 4B:
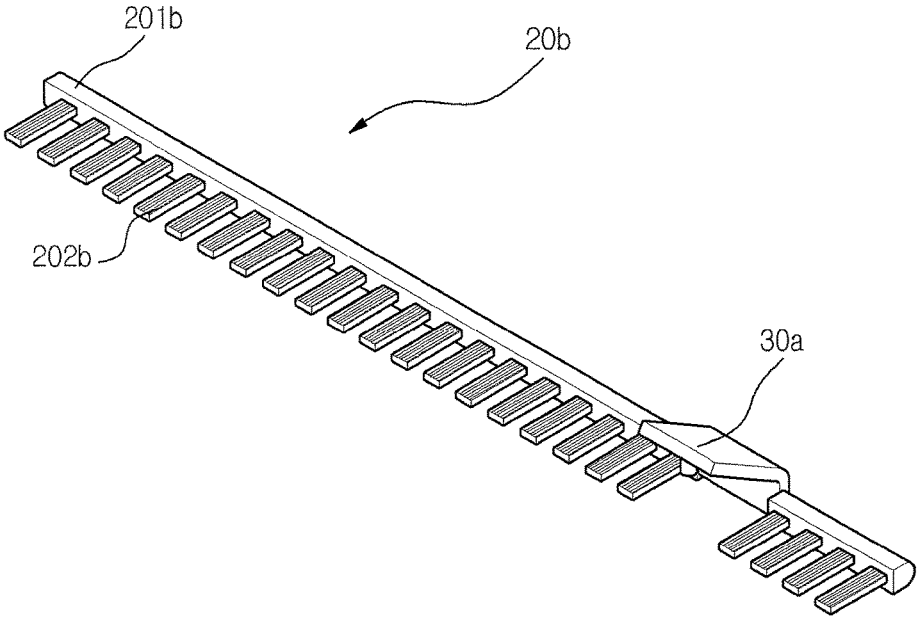
FIG. 4B is a view showing another example of the dust removal unit of the upright cleaner according to an embodiment.

FIG. 4B is a view showing another example of the dust removal unit of the upright cleaner according to an embodiment.

The dust removal unit 20 may include a bar-type body 201 and a dusting part 202 extending from the body 201.

As shown in FIG. 4A, a dusting part 202*a* may include a brush formed over a body 201*a*.

On the other hand, the dust removal unit 20*b* of FIG. 4B may include a bar-type body 201*b* and a dusting part 202*b* extending from the body 201*b*, the dusting part 202*b* possibly including one or more brush bundles arranged at intervals.

In all embodiments which will be described below, the dust removal unit 20*b* may be configured so that the dusting part 202*b* includes one or more brush bundles arranged at intervals.

The dusting parts 202*a* and 202*b* of FIGS. 4A and 4B may be made of acrylonitrile butadiene styrene copolymer. The dusting parts 202*a* and 202*b* exhibit strength sufficient to sweep dust from the drum brush 50.

Hereinafter, the operation of a dust removal unit according to an embodiment will be described with reference to FIGS. 5A and 5B.

Figure 5A:
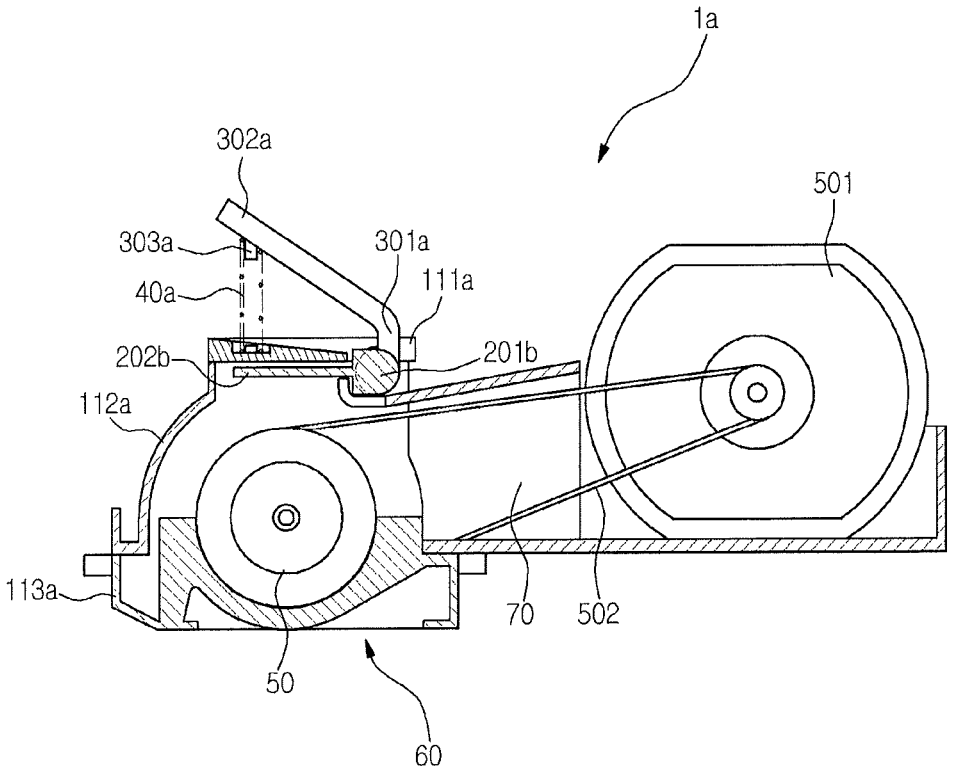
FIG. 5A is a view showing a state in which a dust removal unit according to an embodiment is not operated.
Figure 5B:
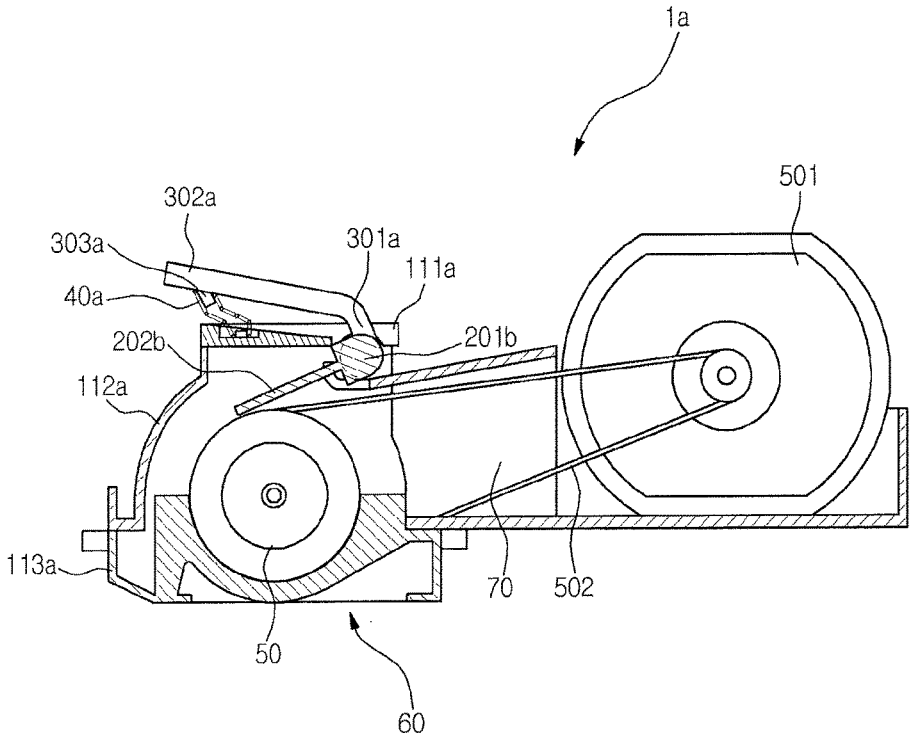
FIG. 5B is a view showing a state in which the dust removal unit according to an embodiment is operated.

FIGS. 5A and 5B are sectional views of the suction body 1*a* with the brush provided at the drum brush 50 being omitted.

FIG. 5A is a view showing a state in which a dust removal unit according to an embodiment is not operated.

As shown in FIG. 5A, the bent part 302*a* of the lever may be pushed upward by elastic force of the elastic part 40*a* provided at the upper part of the case 10*a*, and the entirety of the lever 30*a*, including the extension part 301*a* integrally formed at the bent part 302*a*, may be rotated upward.

Upon rotation of the lever 30*a*, the body 201*b* of the dust removal unit 20*b* connected to the other side of the lever 30*a* may be rotated with the result that the dusting part 202*b* extending from the body 201*b* may also be rotated and may thus be separated from the drum brush 50.

When the motor 501 is driven, rotational force from the motor 501 may be transmitted to the drum brush 50 via the belt 502 to rotate the drum brush 50.

Consequently, the drum brush 50 may be operated without interference with the dusting part 202*b*.

Although not shown, suction force may be generated by the blowing device provided in the main body 2.

The drum brush 50 may be rotated, while contacting the floor in a room, to separate foreign matter from the floor. The separated foreign matter may be suctioned into the suction port 60 provided at the lower part of the front of the case 10*a* of the suction body 1*a* together with air by the suction force generated by the blowing device.

The suctioned air and the foreign matter contained in the air may be introduced into the dust collection device (not shown) through a discharge port 70.

The foreign matter may be collected in the dust collection device, and the air may be discharged from the suction body 1*a*.

FIG. 5B is a view showing a state in which the dust removal unit according to an embodiment is operated.

As shown in FIG. 5B, when a user pushes the bent part 302*a* of the lever 30*a* of the upright cleaner with his/her foot or hand, the entirety of the lever 30*a*, including the extension part 301*a* integrally formed at the bent part 302*a*, may be rotated downward.

Upon rotation of the lever 30*a*, the body 201*b* of the dust removal unit 20*b* and the dusting part 202*b* extending from the body 201*b* may be rotated with the result that the dusting part 202*b* may contact the drum brush 50.

The motor 501 and the drum brush 50 may be rotated in the same manner as previously described.

Upon rotation of the drum brush 50, hair or dust may be separated from the drum brush 50 by the dusting part 202*b* contacting the drum brush 50.

Air may be suctioned into the suction port 60 by suction force generated by the blowing device, and the separated hair and dust may be introduced into the dust collection device together with the air through the discharge port 70.

The hair and dust may be collected in the dust collection device, and the air may be discharged from the suction body 1*a*, in the same manner as previously described.

When the user releases the bent part 302*a* of the lever 30*a*, the bent part 302*a* of the lever may be pushed upward by elastic force of the elastic part 40*a*, as shown in FIG. 5A, and the entirety of the lever 30*a*, including the extension part 301*a* integrally formed at the bent part 302*a*, may be rotated upward.

Upon rotation of the lever 30*a*, the body 201*b* of the dust removal unit 20*b* may be rotated with the result that the dusting part 202*b* may be separated from the drum brush 50 in the same manner as previously described.

Figure 6:
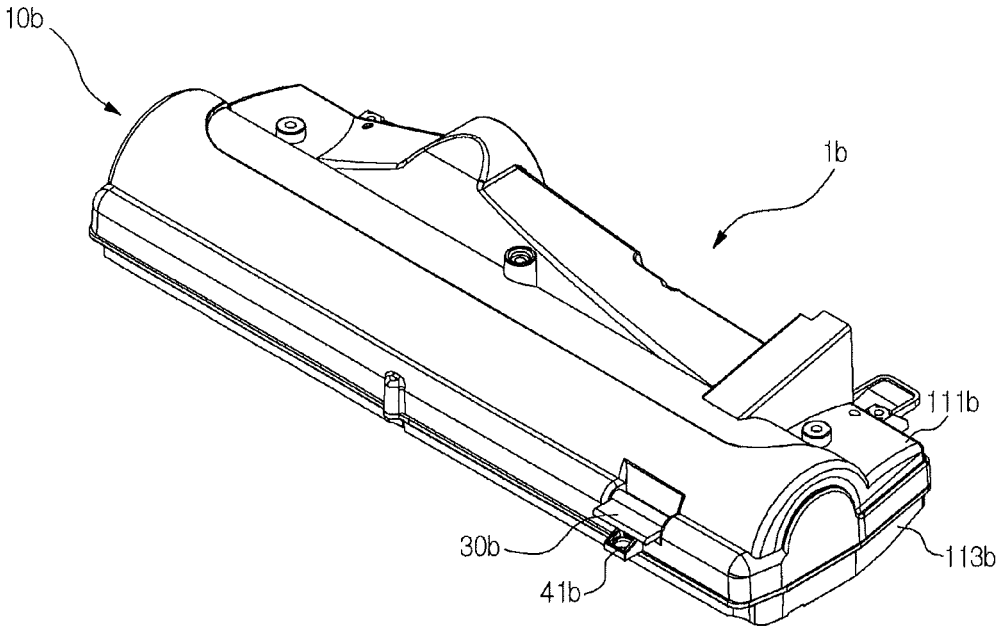
FIG. 6 is a perspective view schematically showing the external appearance of a suction body of an upright cleaner according to another embodiment.

FIG. 6 is a perspective view schematically showing the external appearance of a suction body of an upright cleaner according to another embodiment.

As shown in FIG. 6, a suction body 1*b* may be identical in construction to the previous embodiment in that the suction body 1*b* may include a case 10*b*, a suction port 60, a discharge port 70, a drum brush 50, a motor (not shown), a belt (not shown), a dust removal unit 20*b* and a lever 30*b*.

The case 10*b* may include an upper case 111*b* constituting the upper end of the case and a lower case 113*b*, at which the suction port 60 is provided, to support the drum brush 50.

The dust removal unit 20*b* may include a bar-type body 201*b* and a dusting part 202*b* including one or more brush bundles arranged at intervals, as previously described.

One side of the lever 30*b* may form an extension part 301*b* protruding forward from the upper case 111*b*, and the other side of the lever 30*b* may be connected to a body 201*b* of the dust removal unit 20*b*.

At the lower end of the extension part 301*b* may be provided a support part 41*b* protruding forward from the upper case 111*b*.

An elastic part 40*b* may be provided between the extension part 301*b* of the lever 30*b* and the support part 41*b* of the upper case 111*b* to elastically bias the extension part 301*b* upward.

In this embodiment, the elastic part 40*b* may include a spring, as previously described. Also, the elastic part 40*b* may include an elastic member to elastically bias the extension part 301*b* upward in addition to the spring.

In this embodiment, the lever 30*b* and the dust removal unit 20*b* may be disposed at the front of the upper case 111*b*, and therefore, the upper end of the upper case 111*b* may be formed in the shape of a semicircle.

In a case in which the upper case 111*b* surrounding the drum brush 50 is formed in the semicircular shape, foreign matter may be easily suctioned and discharged.

Hereinafter, the operation of a dust removal unit according to another embodiment will be described with reference to FIGS. 7A and 7B.

Figure 7A:
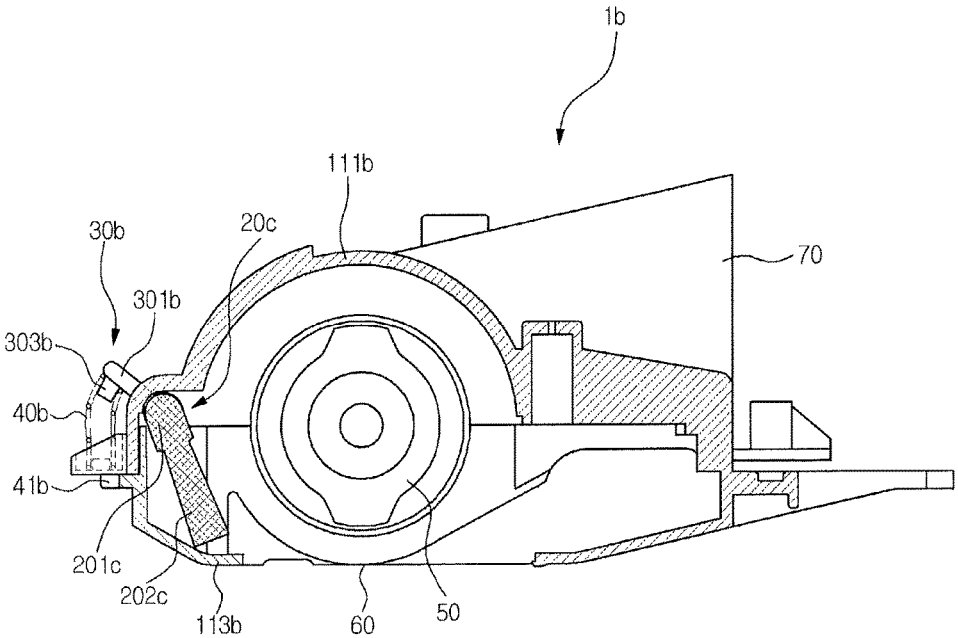
FIG. 7A is a view showing a state in which a dust removal unit according to another embodiment is not operated.
Figure 7B:
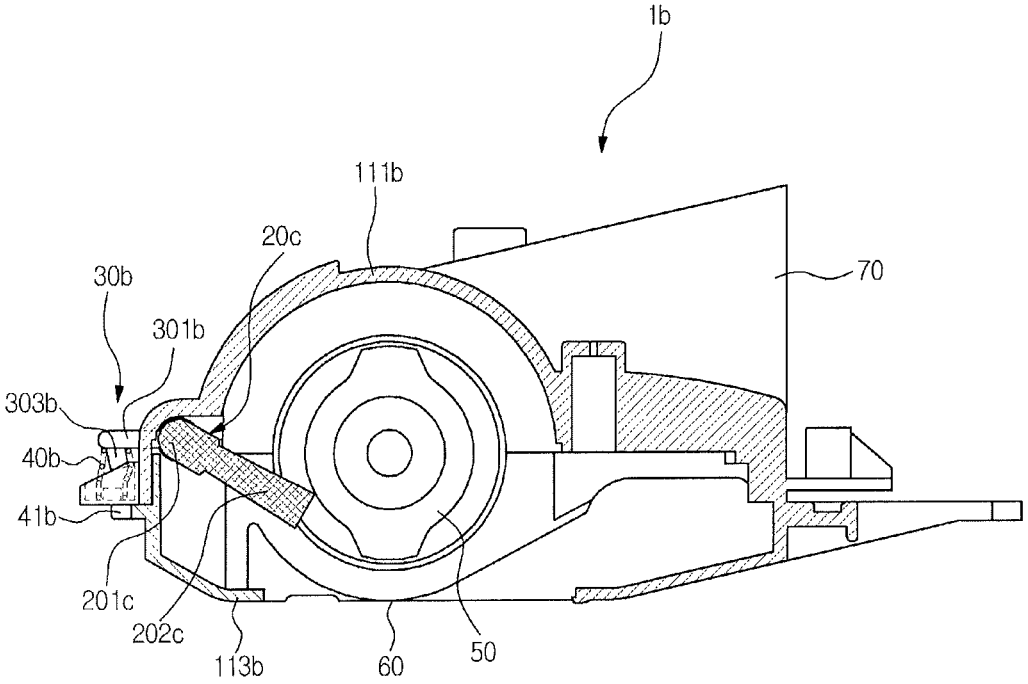
FIG. 7B is a view showing a state in which the dust removal unit according to the embodiment is operated.

FIGS. 7A and 7B are sectional views of the suction body 1*b* with the brush provided at the drum brush 50 being omitted.

FIG. 7A is a view showing a state in which a dust removal unit according to another embodiment is not operated.

The extension part 301*b* may be pushed upward by elastic force of the elastic part 40*b*, and the entirety of the lever 30*b* may be rotated upward.

Upon rotation of the lever 30*b*, the body 201*b* of the dust removal unit 20*b* connected to the other side of the lever 30*b* may be rotated with the result that the dusting part 202*b* may be separated from the drum brush 50.

In this state, the upright cleaner may be operated in the same manner as described with reference to FIG. 5A.

FIG. 7B is a view showing a state in which the dust removal unit according to the embodiment is operated.

As shown in FIG. 7B, when a user pushes the extension part 301*b* of the upright cleaner with his/her foot or hand, the lever 30*b* may be rotated downward.

Upon rotation of the lever 30*b*, the body 201*b* of the dust removal unit 20*b* may also be rotated with the result that and the dusting part 202*b* extending from the body 201*b* may contact the drum brush 50.

Upon rotation of the drum brush 50, hair or dust may be separated from the drum brush 50 by the dusting part 202*b* contacting the drum brush 50.

Air may be suctioned into the suction port 60, and the separated hair and dust may be introduced into the dust collection device together with the air through the discharge port 70 by suction force.

The hair and dust may be collected in the dust collection device, and the air may be discharged from the suction body 1*b*.

When the user releases the extension part 301*b*, the extension part 301*b* may be pushed upward by elastic force of the elastic part 40*b*, as shown in FIG. 7A, and the entirety of the lever 30*b* may be rotated upward.

Upon rotation of the lever 30*b*, the dusting part 202*b* may be separated from the drum brush 50 in the same manner as previously described.

Figure 8:
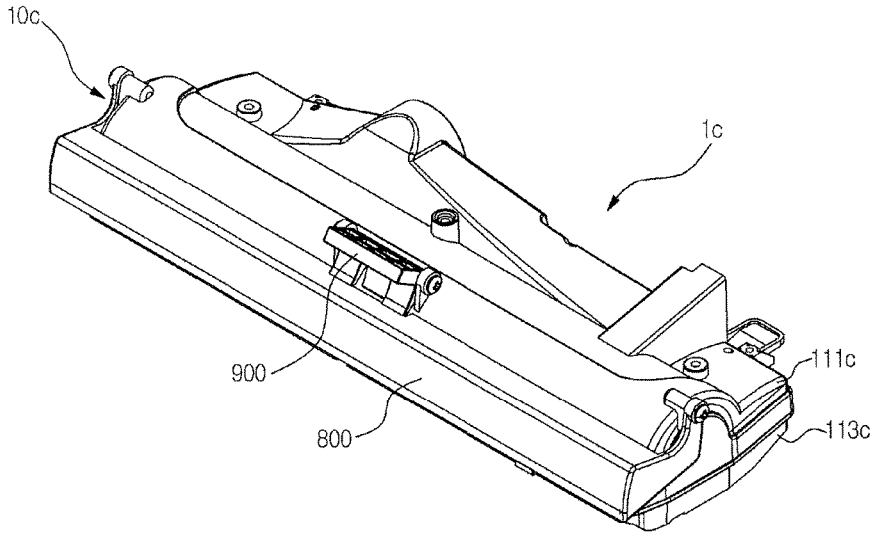
FIG. 8 is a perspective view schematically showing the external appearance of a suction body of an upright cleaner according to yet another embodiment.

FIG. 8 is a perspective view schematically showing the external appearance of a suction body of an upright cleaner according to yet another embodiment.

Figure 9:
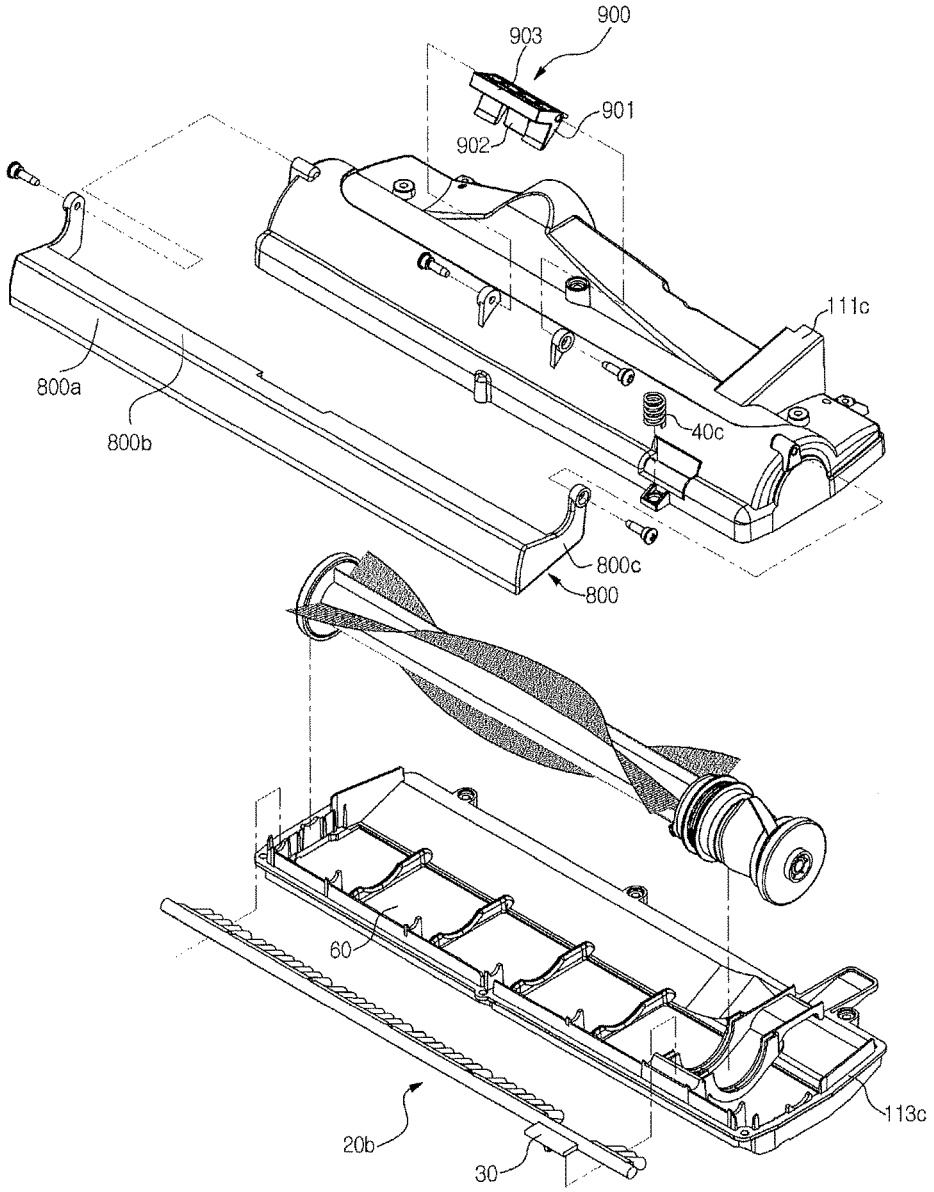
FIG. 9 is an exploded view showing components of the suction body of the upright cleaner according to an embodiment.

FIG. 9 is an exploded view showing components of the suction body of the upright cleaner according to the embodiment.

As shown in FIGS. 8 and 9, a suction body 1*c* may be identical in construction to the previous embodiment in that the suction body 1*c* may include a case 10*c*, a suction port 60, a drum brush 50, a dust removal unit 20*b* and a lever 30*c*.

Hair or dust may be tangled on a brush provided at the outer circumference of the drum brush 50, as previously described.

The case 10*c* may include an upper case 111*c* constituting the upper end of the case and a lower case 113*c*, coupled to the lower end of the upper case 111*c* to support the drum brush 50, at which the suction port 60 is provided.

The dust removal unit 20*b* may include a bar-type body 201*b* and a dusting part 202*b* possibly including one or more brush bundles extending from the body 201*b* while being arranged at intervals, as previously described.

One side of the lever 30*c* may form an extension part 301*c* protruding forward from the upper case 111*c*, and the other side of the lever 30*c* may be connected to a body 201*b* of the dust removal unit 20*b*.

At the lower end of the extension part 301*c* may be formed a support part 41*c* protruding forward from the upper case 111*c*.

An elastic part 40*c* may be provided between the extension part 301*c* and the support part 41*c* of the upper case 111*c* to elastically bias the extension part 301*c* upward.

At the front of the extension part 301*c* may be provided an actuating unit 800 configured to cover the extension part 301*c*.

The actuating unit 800 may include a front plate 800*a*, an upper plate 800*b* and side plates 800*c*.

The front plate 800*a*, formed in the shape of a rectangle longer from side to side, may be provided at the front of the extension part 301*c*, the upper plate 800*b* may be connected to the upper end of the front plate 800*a* and may be bent rearward, and the side plates 800*c* may be coupled to the sides of the front plate 800*a* and the upper plate 800*b*.

In the actuating unit 800, a pressing part 801 may be coupled to the inside of the front plate 800*a* at a position corresponding to the extension part 301*c*.

A connection part may be provided at one side of each side plate 800*c* of the actuating unit 800. The connection parts may be hingedly coupled to the sides of the upper case 111*c* so that the actuating unit 800 may be hingedly rotated upward and downward.

A locking unit 900 may be hingedly coupled to the upper case 111*c* above the upper plate 800*b*.

A footstool part 903 may extend frontward from a hinge shaft of the locking unit 900, and an elastic support part 902 extending downward from the hinge shaft may be connected to the footstool part 903.

The rear of the elastic support part 902 may contact the upper case 111*c* to elastically bias the locking unit 900 in the forward direction.

A pair of catching parts 901 may extend downward from the hinge shaft so that the end of each catching part 901 may protrude more forward than the end of the elastic support part 902.

Hereinafter, the operation of a dust removal unit according to yet another embodiment will be described with reference to FIGS. 10A and 10B.

Figure 10A:
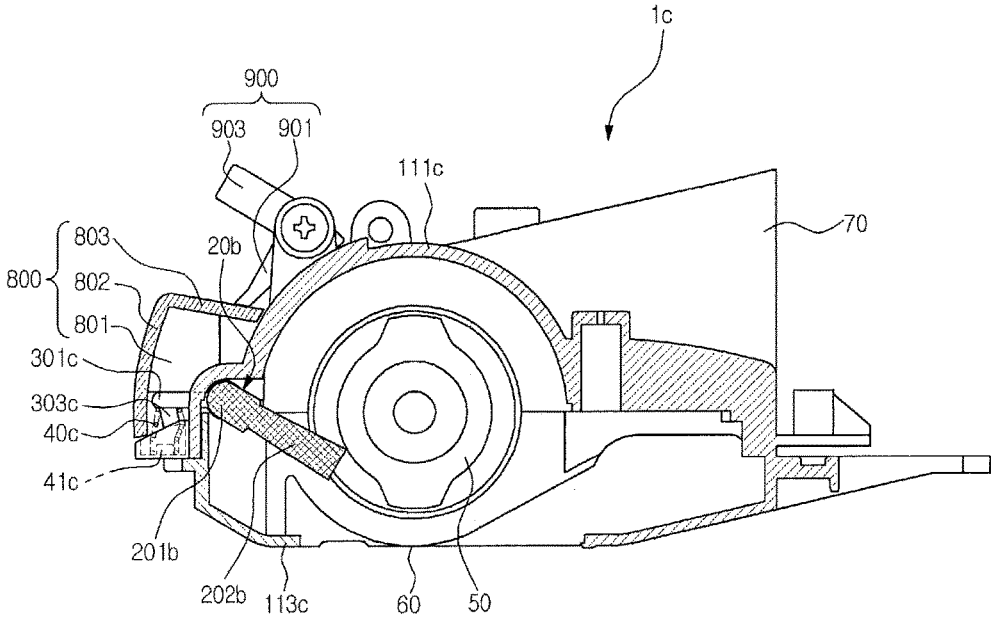
FIG. 10A is a view showing a state in which a dust removal unit according to yet another embodiment is operated.
Figure 10B:
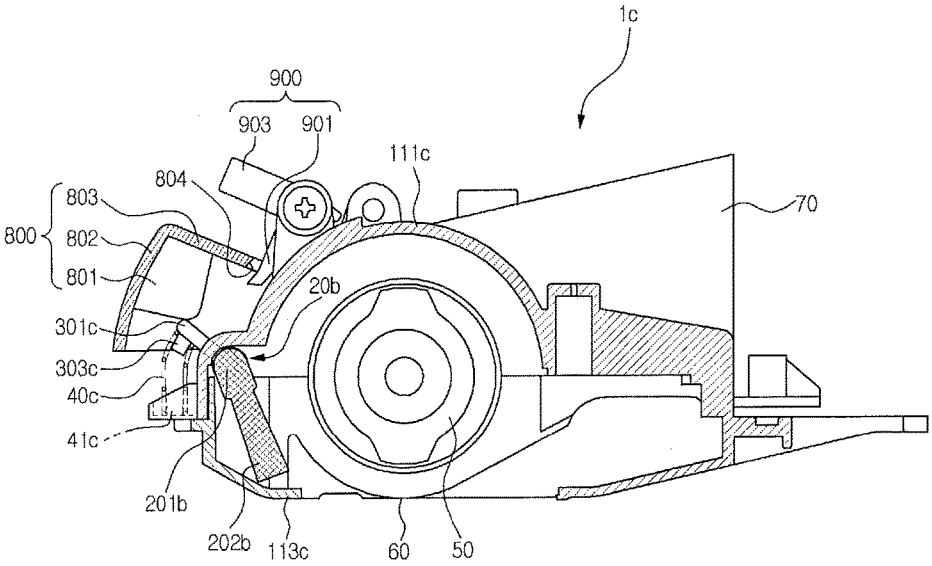
FIG. 10B is a view showing a state in which a dust removal unit according to yet another embodiment is not operated.

FIGS. 10A and 10B are sectional views of the suction body 1*b* with the brush provided at the drum brush 50 being omitted.

FIG. 10A is a view showing a state in which a dust removal unit according to yet another embodiment is operated.

When a user pushes the actuating unit 800 with his/her foot or hand so that the actuating unit 800 is located at an actuating position, the pressing part 801 may press the extension part 301*c* so that the extension part 301*c* is rotated downward.

Upon downward rotation of the extension part 301*c*, the dust removal unit 20*b* may be rotated with the result that the dusting part 202*b* is located at a first position where the dusting part 202*b* contacts the drum brush 50.

Upon rotation of the drum brush 50, hair or dust may be separated from the drum brush 50 by the dusting part 202*b* contacting the drum brush 50.

The separated hair and dust may be introduced into the dust collection device together with air suctioned into the suction port 60 through the discharge port 70 by suction force.

The hair and dust may be collected in the dust collection device, and the air is discharged from the suction body 1*c*.

The entirety of the locking unit 900 may be rotated clockwise by elasticity of the elastic support part 902 (see FIG. 9).

The catching parts 901 may protrude forward, and the lower ends of the catching parts 901 may push the top of the upper plate 800*b* downward so that the actuating unit 800 may be held at the actuating position.

Even when the user releases the actuating unit 800, therefore, the actuating unit 800 may remain at the actuating position, and the dust removal unit 20*b* also may remain at the first position. Consequently, the operation of the dust removal unit 20*b* may not stopped.

FIG. 10B is a view showing a state in which a dust removal unit according to yet another embodiment is not operated.

When a user pushes the footstool part 903 of the locking unit 900, the locking unit 900 may be rotated counterclockwise against the elasticity of the elastic support part 902 (see FIG. 9).

The protrusion degree of the catching parts 901 may be reduced with the result that the ends of the catching parts 901 may approach the upper case 111*c*, and one end of each of the catching parts 901 may be received into a corresponding insertion groove 804.

As one end of each of the catching parts 901 is inserted into the corresponding insertion groove 804, force pressing the upper plate 800*b* downward may be removed.

The extension part 301*c* may be pushed upward by elasticity of the elastic part 40*c*, and the entirety of the lever 30*c* may be rotated upward.

The extension part 301*c* may push the pressing part 801 upward, and the entirety of the actuating unit 800 may be rotated upward.

Upon rotation of the lever 30*c*, the dust removal unit 20*b* may be moved to a second position where the dusting part 202*b* is separated from the drum brush, as previously described.

As is apparent from the above description, hair or dust may be removed from the drum brush without separation of the drum brush.

A normal cleaning operation may be performed without removal of dust from the drum brush.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An apparatus comprising:

a case;

a brush provided in the case and configured to rotate to sweep foreign matter;

a dust removal member comprising a bar-type body and a dusting part directly extending from the bar-type body, the dusting part configured to pivot between a first position where the dusting part contacts the brush and a second position where the dusting part is separated from the brush;

a first part connected to the bar-type body; and a second part integrally formed with the first part and extending from the first part, wherein when a force is applied to the second part, the force is transmitted through to the first part and to the dust removal member such that the dusting part pivots from the second position to the first position.

2. The apparatus according to claim 1, further comprising an elastic part to elastically bias the second part, wherein when the force is released, the dusting part moves from the first position to the second position due to the elastic part.

3. The apparatus according to claim 1, wherein the first part protrudes above the case and the second part is bent from an end of the first part toward a front of the case.

4. The apparatus according to claim 1, wherein the first part protrudes forward from the case.

5. The apparatus according to claim 2, further comprising a support part protruding from the case, wherein the elastic part is provided between the support part and the first part to elastically bias the first part in an upward direction.

6. The apparatus according to claim 1, further comprising an actuating member coupled to the case, the actuating member configured to be moved between an actuating position at which the first part is pressed and a releasing position at which the first part is released.

7. The apparatus according to claim 6, wherein the actuating member comprises a front plate provided at a front of the first part and an upper plate connected to an upper end of the front plate and bent rearward.

8. The apparatus according to claim 6, further comprising an elastic part to elastically bias the first part, the second part extending downward from an end of the first part to hold an upper end of the elastic part.

9. A cleaning apparatus comprising:

a case housing a suction port;

a drum brush provided in the case;

a dust removal member having a dusting part configured to pivot between a first position at which the dusting part contacts the drum brush and a second position at which the dusting part is separated from the drum brush;

a first part extending from the dust removal member;

a second part integrally formed with an extension part and extending from an end of the extension part, wherein when a force is applied to the second part, the force is transmitted through to the first part and to the dust removal member such that the dusting part pivots from the second position to the first position.

* * * * *